US007426895B2

(12) United States Patent
Smith et al.

(10) Patent No.: US 7,426,895 B2
(45) Date of Patent: Sep. 23, 2008

(54) TUFTING MACHINE AND PROCESS FOR VARIABLE STITCH RATE TUFTING

(75) Inventors: Jeff Smith, Hixson, TN (US); Mike Bishop, Signal Mountain, TN (US); Brian Lovelady, Soddy Daisy, TN (US); Roberta M. Rumfola, Hamburg, NY (US)

(73) Assignee: Tuftco Corporation, Chattanooga, TN (US)

( * ) Notice: Subject to any disclaimer, the term of this patent is extended or adjusted under 35 U.S.C. 154(b) by 388 days.

(21) Appl. No.: 11/243,728

(22) Filed: Oct. 5, 2005

(65) Prior Publication Data

US 2006/0070564 A1 Apr. 6, 2006

Related U.S. Application Data

(60) Provisional application No. 60/615,982, filed on Oct. 5, 2004.

(51) Int. Cl.
*D05C 15/12* (2006.01)
*D05C 15/14* (2006.01)

(52) U.S. Cl. ..... 112/80.32; 112/80.43

(58) Field of Classification Search ..... 112/80.3–80.45, 112/80.75

See application file for complete search history.

(56) References Cited

U.S. PATENT DOCUMENTS

| | | | | | |
|---|---|---|---|---|---|
| 2,983,028 | A * | 5/1961 | Cole | 428/85 |
| 4,241,675 | A * | 12/1980 | Bardsley | 112/80.51 |
| 5,005,498 | A * | 4/1991 | Taylor et al. | 112/80.32 |
| 5,189,966 | A * | 3/1993 | Satterfield | 112/80.53 |
| 5,392,723 | A * | 2/1995 | Kaju | 112/80.23 |
| 5,575,228 | A * | 11/1996 | Padgett et al. | 112/80.41 |
| 6,516,734 | B1 * | 2/2003 | Morgante et al. | 112/80.73 |
| 7,216,598 | B1 * | 5/2007 | Christman, Jr. | 112/475.23 |

* cited by examiner

*Primary Examiner*—Ismael Izaguirre
(74) *Attorney, Agent, or Firm*—Douglas T. Johnson

(57) ABSTRACT

A tufting machine as disclosed with a variable yarn feed mechanism and a method for tufting patterns with yarns from two rows of needles offset longitudinally from one another in a fashion that the different stitch lengths are selected in a fashion that the yarns from each row of needles are complementary to the other and maintain a consistent stitch density.

17 Claims, 7 Drawing Sheets

TUFTING MACHINE AND PROCESS FOR VARIABLE STITCH RATE TUFTING

The present application claims priority to the Oct. 5, 2004 filing date of U.S. provisional patent application Ser. No. 60/615,982.

FIELD OF THE INVENTION

This invention relates to a tufting machine, and is more particularly concerned with a tufting machine having a servo motor controlled backing feed mechanism and a method for varying the length of selected stitches in a pattern design and creating novel tufted fabrics that simulate woven fabric designs.

BACKGROUND OF THE INVENTION

A tufting machine, especially a tufting machine adapted for the manufacture of carpet, has a pair of pin rollers which are driven to feed a primary backing material off of a large storage roll and over a bed frame. The two pin rollers are disposed on opposite sides of the bed frame so that the first pin roller introduces the primary backing material into the tufting machine, and the second pin roller removes the backing material from the tufting machine. A set of needles are located above the bed frame across the width of the tufting machine and are threaded with yarns. The needles are reciprocated through the action of a needle bar so as to insert the yarns through the primary backing material to form tufts on the face of the primary backing. The tufting machine may have various combinations of loopers and knives to enable the manufacture of loop pile or cut pile bights of yarn on the face of the carpet. Based on the arrangement of threaded needles, loopers and knives, and based on the color of the yarns threaded in the needles, the tufting machine can generate various patterns of yarn bights.

In a conventional mechanical tufting machine, the second pin roller, or exit pin roller, is driven off of a main drive shaft by a pulley and belt arrangement, and the first pin roller, or entry pin roller, is driven off of the exit pin roller by another pulley and belt arrangement. The exit pin roller is driven at a slightly faster speed so as to produce tension across the primary backing material and to insure that the primary backing material is continuously advanced over the bed frame. In addition to the pin rollers, the other parts of a conventional mechanical tufting machine, such as the needle bar and loopers, are also driven off of the main drive shaft.

In these conventional tufting machines, it is necessary to synchronize the feed of the backing material across the bed frame with the speed of reciprocating needles to produce a pre-determined number of stitches per inch in a longitudinal direction of the backing material. In such tufting machines, it has been necessary to change the sheaves of the gear box connected to the entry and exit pin rollers on the tufting machine in order to change the number of stitches per inch. As a result, it was traditionally difficult to change the number of stitches per inch being sewn by the tufting machine, for instance, to arrive at a pre-determined weight for a square yard of carpet. Furthermore, it was practically impossible to provide for different length stitches within the same pattern without utilizing crammed sheaves or other notoriously complicated mechanical arrangements such as described in Ingram, et al., U.S. Pat. No. 4,577,208. These arrangements provided no means for fine tuning the lengths of the varied stitches in the pattern as is typically required if two rows of needles are utilized in the pattern. Also the sheer complexity of the arrangements generally has required operation of conventional tufting machines at slower speeds, and has provided only limited pattern variations.

One development that has enabled greater variability for the backing feed drive is that of a computer controlled tufting machine as exemplified by Taylor, U.S. Pat. No. 5,005,498. Modern computer controlled tufting machines use separate servo motors to drive the entry and exit backing feed rolls in ratio to the speed of the main drive shaft. While these computer controlled servo motor driven backing feed rolls have provided a straightforward solution to the problem of changing stitch density, and have provided greater versatility in controlling the backing feed, they did not suggest utilizing a variable stitch rate in tufting fabrics. Similarly, the invention of Ingram, U.S. Pat. No. 4,577,208, while providing a variable stitch rate, also correspondingly produced varied stitch density. While such patterning is useful in some instances, most carpet is preferred with a relatively uniform stitch density.

SUMMARY OF THE INVENTION

It is therefore an object of this invention to provide a tufting machine the capability to utilize a variable stitch rate within the tufting of a single carpet pattern.

It is further an object of the present invention to provide a tufting machine in which the stitch rate may be varied without altering the stitch density of the tufted fabric.

DETAILED DESCRIPTION OF THE INVENTION

Figure 1:
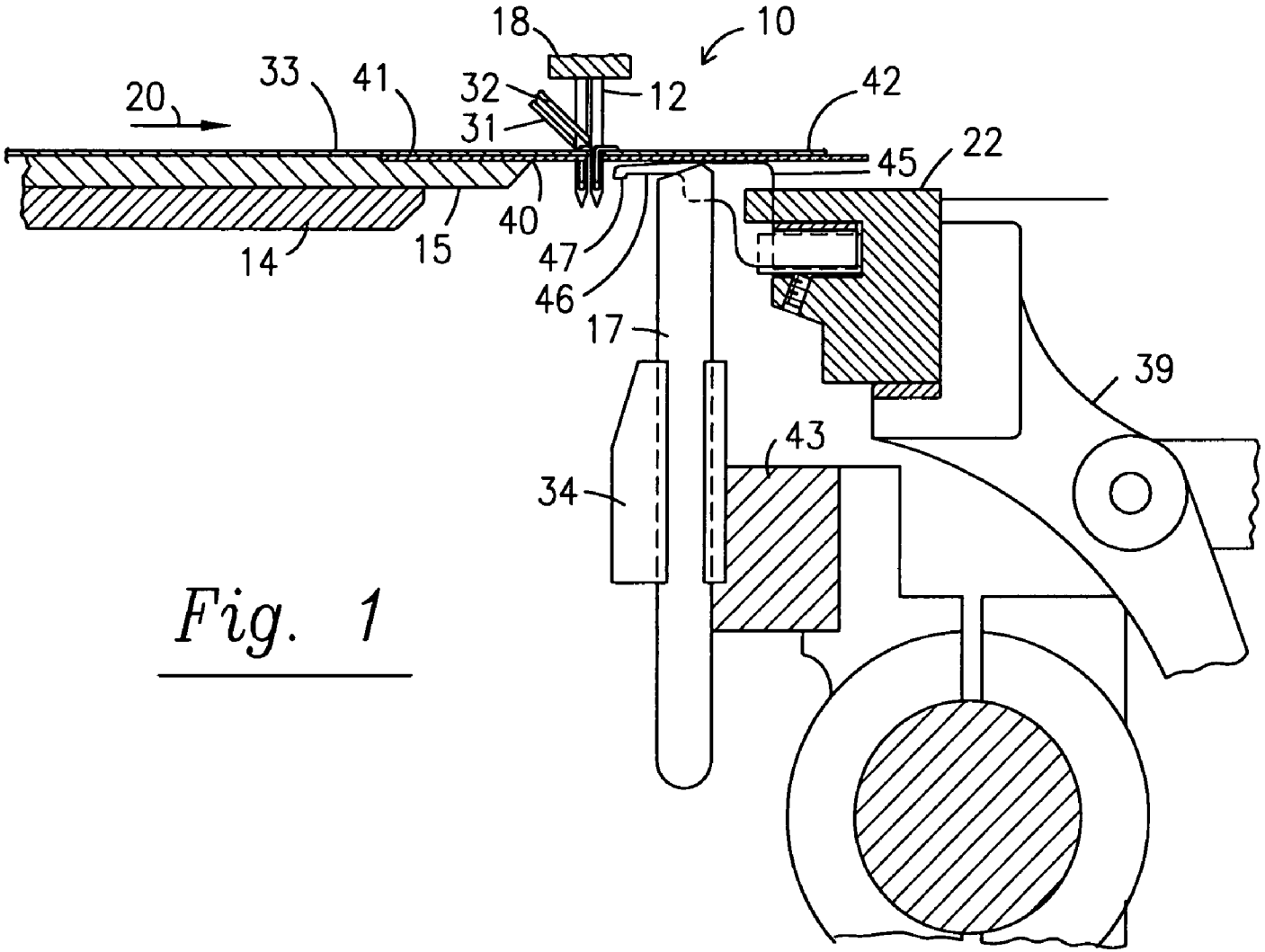
FIG. 1 is a side elevation view of a tufting machine with a staggered needle bar according to the present invention configured to produce cut pile carpet.
Figure 2A:
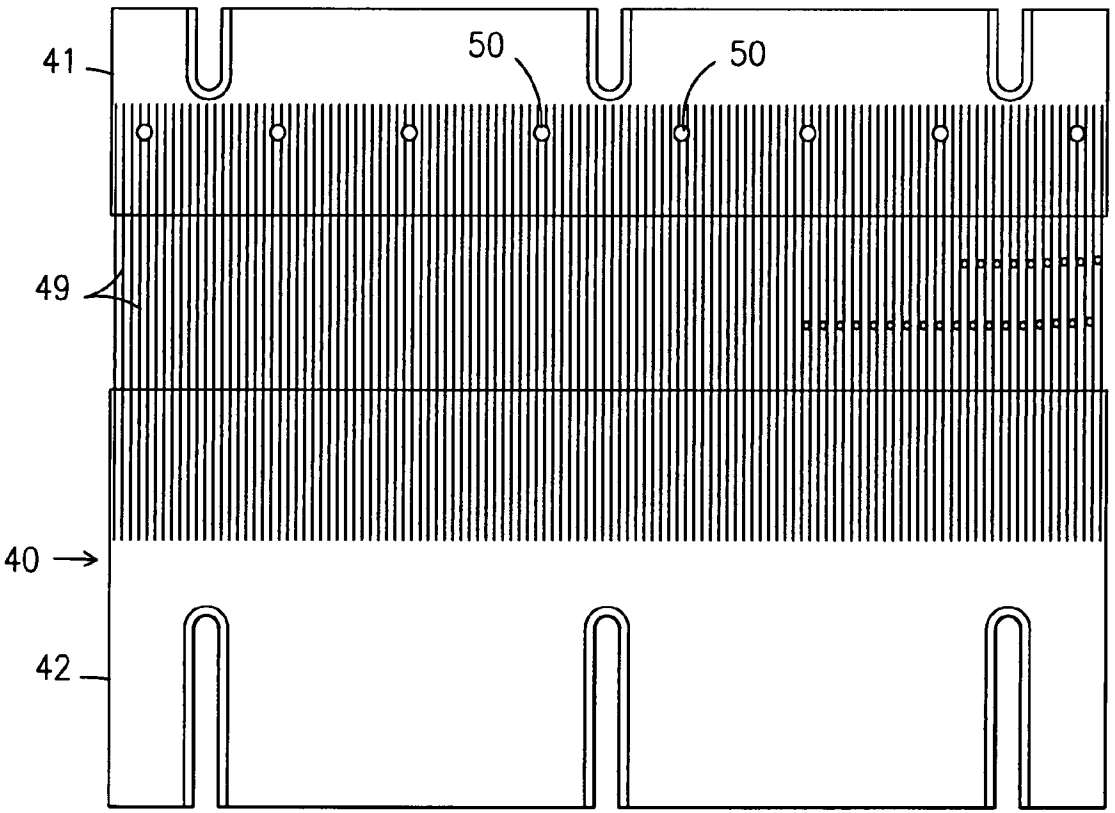
FIG. 2A is a top plan view of a dulcimer needle plate adapted for use in the present invention.
Figure 2B:
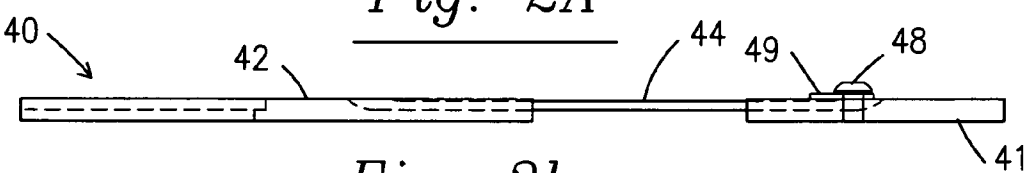
FIG. 2B is a side sectional view of the dulcimer needle plate of FIG. 2A.

Turning first to FIG. 1, a representative cut pile tufting machine 10 with staggered needle bar 18 is shown. The staggered needle bar 18 supports a first row of uniformly spaced rear needles 12 and a second row of uniformly spaced front needles 11 offset midway between the rear needles 12, to provide a uniform narrow gauge staggered needle tufting machine 10. It will be understood that the invention may also be practiced with two independent needle bars, each supporting a row of needles, and each shift able to either place the needles on the front and rear needle bars directly in line or offset as desired. The needle bar 18 is vertically reciprocated by conventional means, not shown, to cause the front and rear needles 11, 12 to move between an upward position, not shown, above the base fabric 33 and a downward position so that the needles will carry front yarns 31 and rear yarns 32 through the base fabric 33 to form loops of tufting therein. The base fabric 33 is supported upon needle plate 40 for movement by a servo motor driven backing feed in the direction of arrow 20, longitudinally from front to rear through the machine.

Loopers 45 are mounted in hook blocks fixed to hook bar 22 which is in turn fixed to rocker arms 39 journeyed on rocker shaft, not shown. The rocker shaft is driven by conventional means to cause limited reciprocal movement of rocker arms 39 in synchronization with the reciprocal movement of needles 11, 12. The illustrated loopers 45 are cut pile hooks with throats 46 and downturned bills 47.

When needles 11, 12 are in their lower position, loopers 45 are moved forward by reciprocating rocker shaft toward the needles 11, 12 until the downturned bills 47 have moved through the yarn loops carried by the front and rear needles 11, 12. Once the yarn loops are seized on the loopers 45, yarn loops are moved in the direction of the fabric feed 20 towards a cutting apparatus, which is illustrated consisting of knife 17 provided for and cooperating with each loopier 45 to produce cut pile tufts or yarn bights. The knives 17 are mounted in knife blocks 34 carried upon transverse knife bar 43 and driven synchronically by well known means to cause the needles 11, 12, the loopers 45, and the knives 17 to cooperate to form cut pile tufts from the yarns 31, 32. It will be understood that the invention may also be practiced with a loopier apparatus to create looped pile tufts, in which case there is no cutting apparatus and the loopers are oriented in the reverse direction so that seized loops of yarn may slide off the loopers as the base fabric 33 is fed through the tufting machine.

The needle plate comprises a plurality of needle plate sections 40 arranged end to end transversely of the tufting machine. The preferred needle plate sections 40 are referred to as a dulcimer system and comprise front plates 41 and rear plates 42 and flat wires 44 extending there between. The preferred wires 44 are approximately 0.022 inches in width and 0.093 inches in height. The ends of wires 44 are received in slots on front and rear needle plate sections 41, 42 and held therein by a cover plate 49 which is mounted by bolts 48 and received in thread apertures 50 on the front needle plate section 41. The front needle plate section 41 is mounted upon an elongated mounting plate 15 and supported in turn upon bed plate 14 of tufting machine 10. For reasons that will become apparent as the method of the invention is explained, the longitudinal spacing between front needles 11 and rear needles 12 will typically be one-quarter or one-half inch on a $20^{th}$ gauge tufting machine. Such a machine typically has $10^{th}$ gauge spacing, or 10 needles per inch, on each of the front and rear rows of needles. Apart from the preferred needle plate and longitudinal spacing between rows of needles, other details of the tufting machine configuration are similar to those disclosed in connection with fine gauge tufting machines typified by Lovelady, U.S. Pat. No. 6,014,937.

Figure 3:
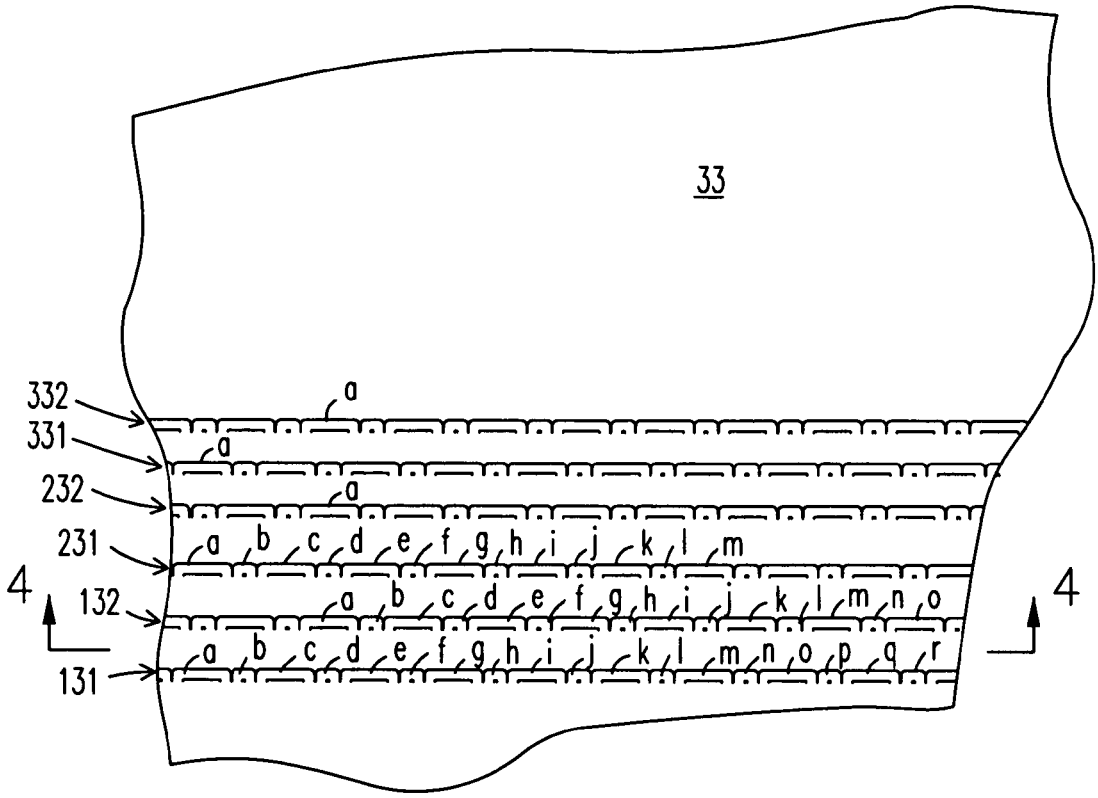
FIG. 3 is a perspective view of a portion of the back stitching of fabric formed according to the present invention showing short and elongated back stitches.
Figure 4:
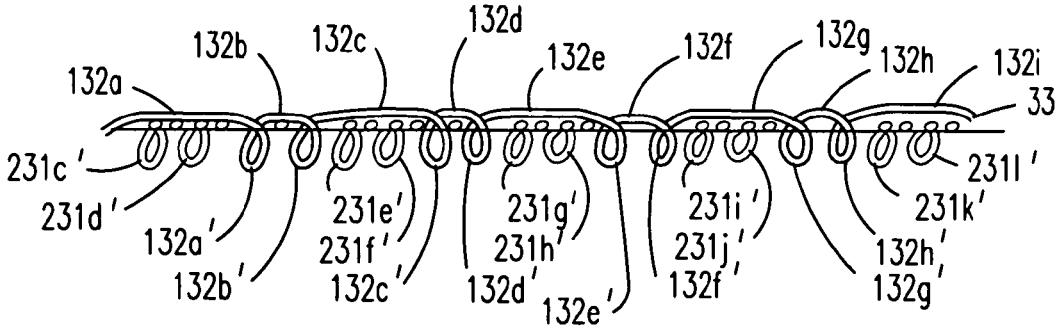
FIG. 4 is a side sectional view of the fabric of FIG. 3 taken along line 4-4' showing both the back stitch and face of the fabric.

FIGS. 3 through 5 illustrate some variable stitch rate fabrics that can be tufted according to the present invention. In FIG. 3, the back stitches of three front yarns 131, 231, 331, and three rear yarns 132, 232, 332 are shown. In the example illustrated, the spacing between front needles 11 and rear needles 12 may be one-half inch and the long stitches, a, c, e have a back stitch length of three-twelfths of an inch and the short stitches, b, d, f have a back stitch length of one-twelfth of an inch. Thus, the front yarns sew stitches 131*a*, 231*a*, 331*a* on the same reciprocating cycle of the needle bar that causes rear needles sew stitches 132*a*, 232*a*, 332*a*. Three stitches later, the front needles 11 tuft back stitches 131*d*, 231*d*, 331*d* at the same longitudinal placement on backing fabric 33 as was previously occupied by stitches 132*a*, 232*a*, and 332*a*.

Yarns 132 and 232 are colored to better illustrate the stitch placement, and taking a sectional view of the carpet of FIG. 3 along line 4-4' as shown in FIG. 4, it can be seen that back stitch 132*a* terminates in yarn tuft 132*a*' on the face of the carpet. The illustrated tuft is a loop pile yarn bight, however, had the fabric been tufted on the tufting machine configured as in FIG. 1, a cut pile bight would result. Following loop pile bight 132*a*', the yarn forms back stitch 132*b* and at the conclusion of that back stitch forms 132*b*'. Back stitch 132*b* is only one-twelfth of an inch in length while the following back stitch 132*c* is three-twelfths of an inch and concludes with loop pile bight 132*c*'. Because of the three-twelfths inch spacing between loop pile bights 132*b*' and 132*c*', it is possible to view the loop pile bights formed by the adjacent front yarn 231, specifically bights 231*e*' and 231*f*', such bights being spaced one-twelfth inch apart themselves as are the corresponding stitches 132*e*', 132*f*' that were formed by the same downward cycle of the needle bars.

Figure 5A:
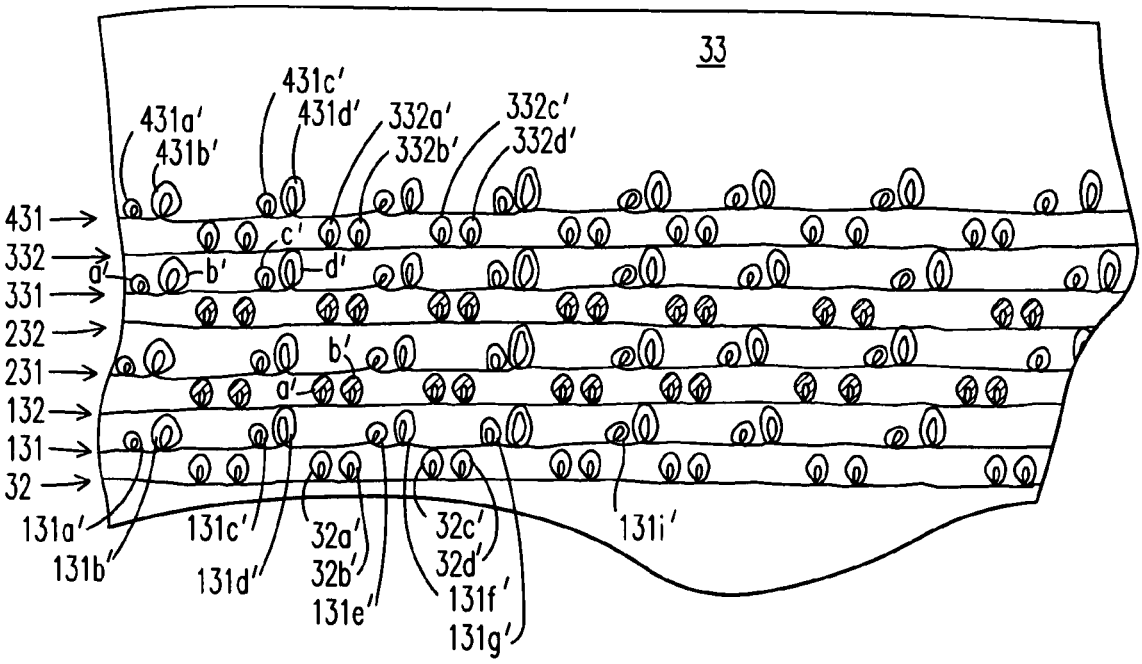
FIG. 5A is an illustration of the face of the fabric corresponding to the back stitches shown in FIG. 3.

FIG. 5A depicts the face of a similar fabric tufted by staggered front and rear needles with front yarns 131, 231, 331, 431 and rear yarns 32, 132, 232, 332. Rear yarns 132, 232 are colored for pattern effect. In addition to the varied stitch lengths previously discussed, this pattern demonstrates the additional use of a varied yarn feed. In particular, at the conclusion of the long stitches a, c, e, the yarn to the front needles 11 is underfed so that stitches 131*a*', 231*a*', 331*a*', 431*a*' are relatively shorter than the yarn bights of other stitches. Similar shortened yarn bights are illustrated in stitches 131*c*', 231*c*', 331*c*', 431*c*' and on e', g' and i' of stitches of the front yarns. The yarn bights formed with rear yarns are not shortened and, accordingly, it will be seen that the yarns were fed by different yarn feed drives. This relatively simple underfeeding of front yarns could be accomplished with a simple roll attachment for front yarns separate from rear yarns, however, much more complex high/low patterning capabilities may be created through the use of a servo scroll or single end scroll yarn feed attachments described in U.S. Pat. Nos. 6,516,734 and 6,508,185.

Figure 5B:
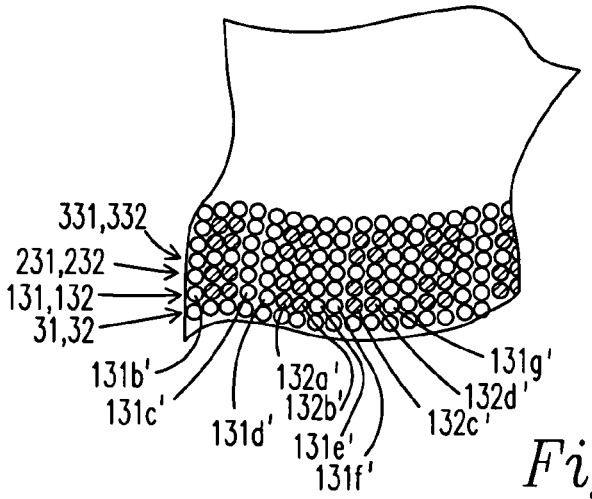
FIG. 5B is an illustration of the face of the fabric of FIG. 5A with the tufting needles sewn in line rather than staggered.

FIG. 5B depicts the pattern of FIG. 5A if front and rear needles 11, 12 are sewn substantially in-line so that front yarn 131 and rear yarn 132 form a single line of tufts alternating low white tuft, high white tuft, two colored tufts, adjacent to yarns 231, 232 tufted identically, and adjacent to yarns 331, 332 which are both white yarns. Thus, we see the row of stitches formed by yarns 131, 132 beginning on the fourth stitch of 131*c*' and then follows with stitch 131*d*', 132*a*', 132*b*', 131*e*', 131*f*', 132*c*', 132*d*', 131*g*' and so forth, alternating with two stitches from front needles with front white yarn and two stitches from rear needles with rear colored yarn to produce a pattern of colored squares on a background that imitates a woven flat weave effect.

Figure 6:
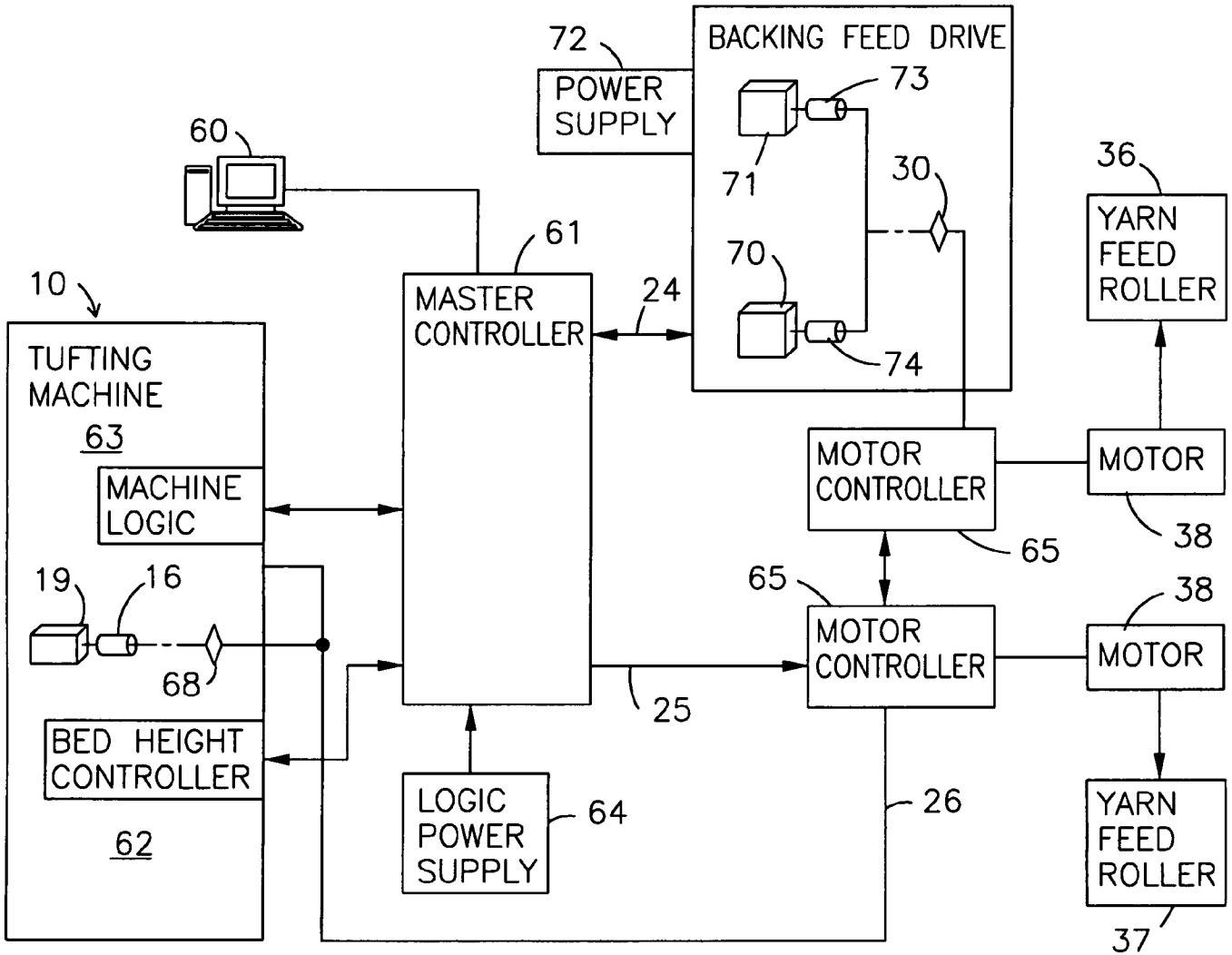
FIG. 6 is a schematic view of the electrical flow diagram for a multiple needle tufting machine operating a servo motor driven backing feed.

A computerized tufting machine adapted to manufacture fabrics according to the present invention is shown in FIG. 6. A personal computer 60 is provided as a user interface, and this computer 60 may also be used to create, modify, display and install patterns in the tufting machine 10 by communication with the tufting machine master controller 61. Master controller 61 in turn preferably interfaces with machine logic 63, so that various operational interlocks will be activated if, for instance, the controller 61 is signaled that the tufting machine 10 is turned off, or if the "jog" button is depressed to incrementally move the needle bar, or a housing panel is open, or the like. Master controller 61 may also interface with a bed height controller 62 on the tufting machine to automatically effect changes in the bed height when patterns are changed.

Master controller 61 also receives information from encoder 68 relative to the position of the main drive shaft 16 and preferably sends pattern commands 24 to and receives status information from controllers 70, 71 respectively for backing tension motor 74 which drives the backing feed entry pin roller, and backing feed motor 73 which drives the backing feed exit pin roller. Said motors 73, 74 are powered by power supply 72. The master controller 61 also sends ratiometric pattern information 25 to motor controllers 65. Motor controllers 65 also receive information 26 from encoder 68 relative to the position of main drive shaft 18.

Motor controllers 65 process the ratiometric information from master controller 61 and main drive shaft positional information from encoder 68 to direct corresponding yarn feed motors 38 to rotate yarn feed rolls 36, 37 the distances necessary to feed the appropriate length of yarn to each needle for each stitch. A backing feed encoder 30 is also available so that the user may select the backing feed drive as a pattern interpreter at the user interface.

Figure 7A:
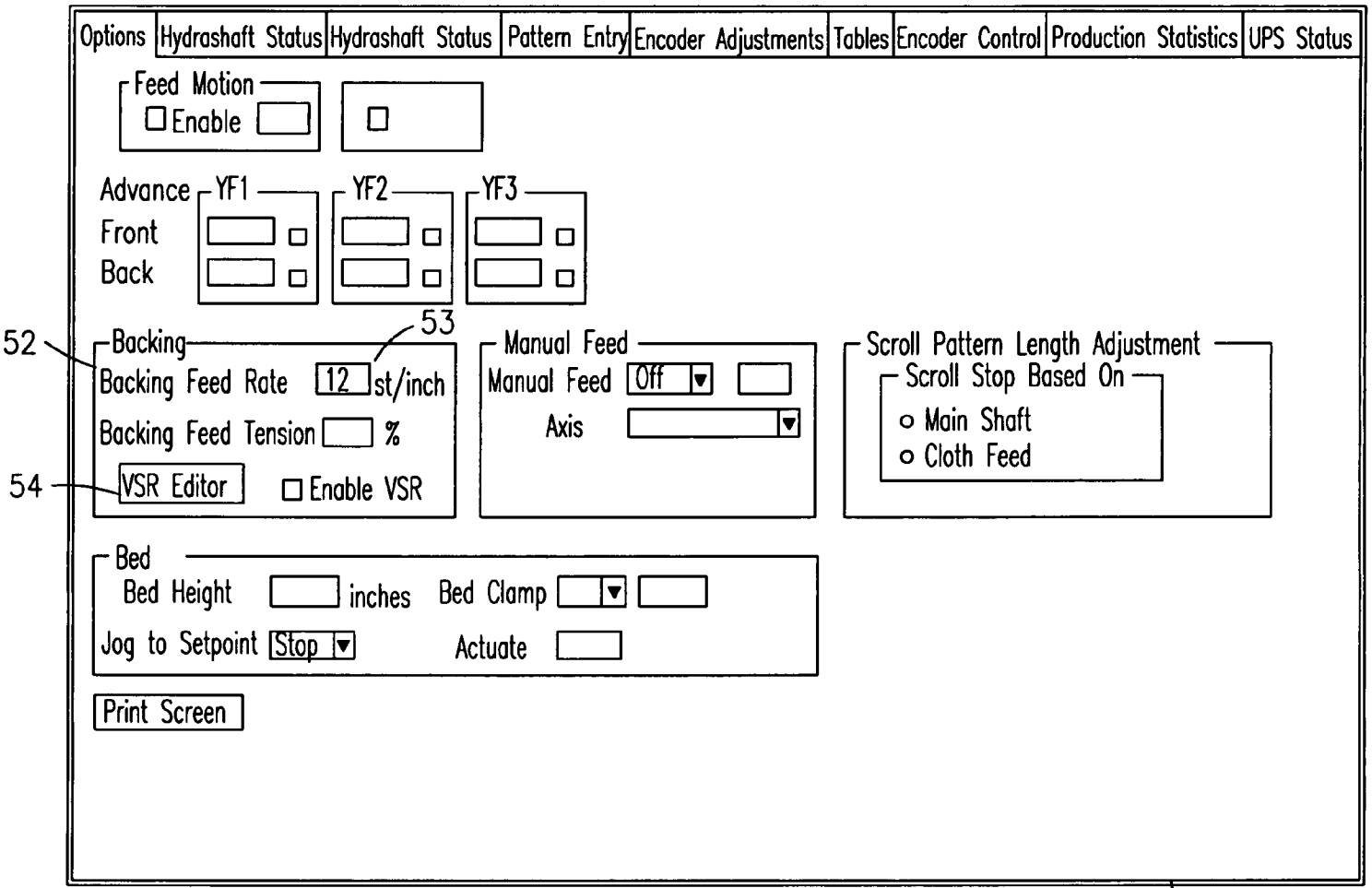
FIG. 7A is an illustration of a data input screen available to a machine operator or pattern designer.
Figure 7B:
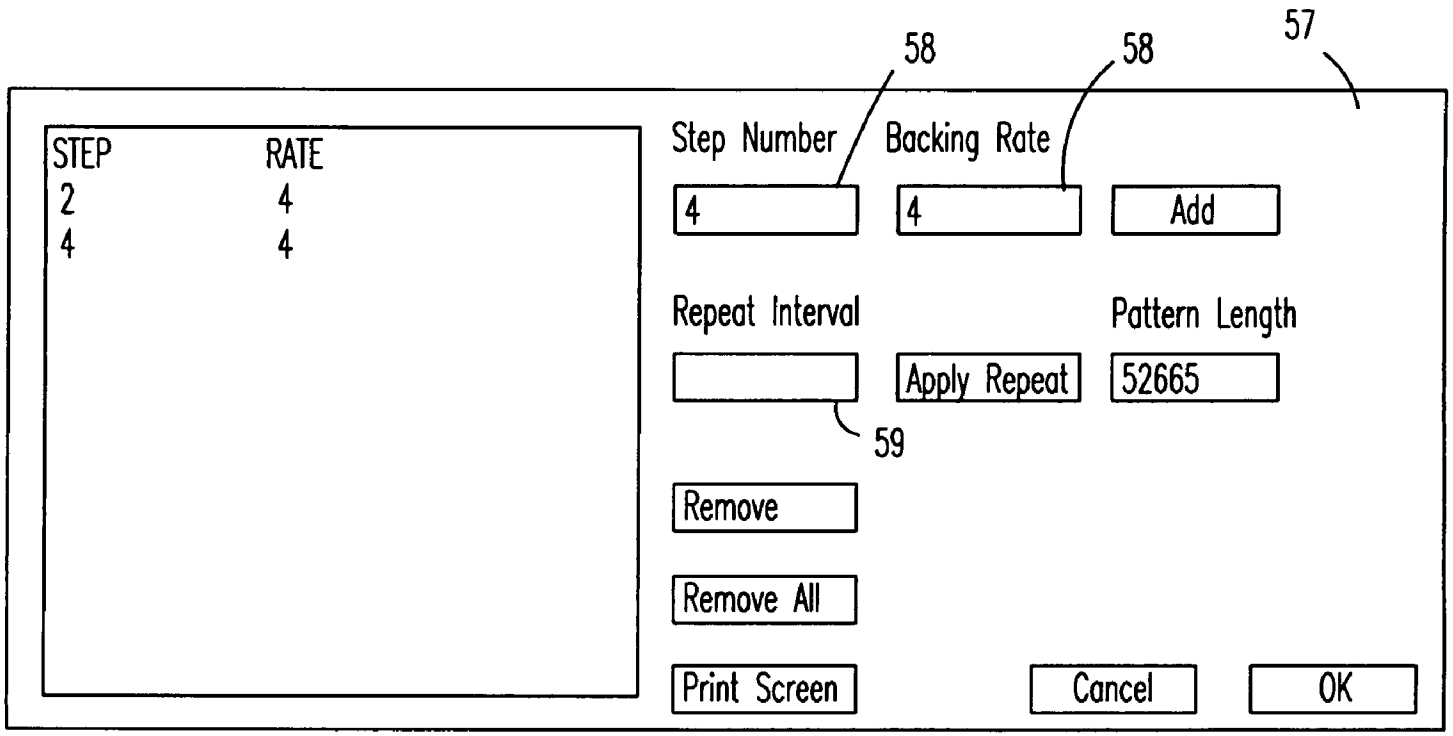
FIG. 7B is a variable stitch rate control screen available to the machine operator or pattern designer.

FIGS. 7A and 7B display representative operator screens that enable programming of variable stitch rate patterns. The illustrated control program provides a variety of controls such as for pattern entry, encoder adjustment, and access to production statistics. Control display 51 is shown with operator access to backing variables 52 and backing feed rate 53 of 12 stitches per inch has been entered. Also accessible is the Variable Stitch Rate ("VSR") Editor 54 and an associated control to enable the variable stitch rate capability. When the VSR Editor 54 is accessed, a data entry screen 57 as shown in FIG. 7B is displayed that permits the entry of different backing feed rates to be applied to a particular stitch or step number of the pattern. The patterns discussed in connection with FIGS. 3 through 5 are simply alternating one-twelfth inch stitches with three-twelfths inch stitches, which are rates of 12 stitches per inch and 4 stitches per inch respectively. Accordingly, it would be possible to simply enter step number 2 at a backing rate of 4 stitches per inch and a repeat interval 59 of two stitches to program the simple variable stitch rate patterns previously discussed.

Variable stitch rate fabrics may also be tufted on a tufting machine with only a single row of transverse needles. For instance, when utilizing servo driven yarn feed apparatus such as typified by those described in commonly assigned U.S. Pat. Nos. 6,244,203 and 6,283,053, it is possible to feed relatively small amounts of yarn to create loop or cut pile bights of low height and to feed more yarn to create yarn bights having a greater height. The backing may be fed at a variable rate when tufting rows of high and low yarn bights so that the backing is advanced in smaller increments when rows of low pile height bights are tufted and the backing is advanced a relatively greater distance when rows of high pile bights of yarns are tufted. In this fashion the resulting fabric maintains a somewhat uniform density of face yarn even though high and low pile heights are being tufted.

All publication, patent, and patent documents are incorporated by reference herein as though individually incorporated by reference. Numerous alterations of the structures and methods herein described will suggest themselves to those skilled in the art. It will be understood that the details and arrangements of the parts and methods herein described and illustrated in order to explain the nature of the invention are not to be construed as any limitation of the invention. Also, such alterations should not depart from the spirit of the invention and are intended to be included within the scope of the appended claims.

What is claimed is:

1. A tufting machine comprising:

a servo motor driven mechanism for moving a base fabric longitudinally through said machine in a feeding direction;

a first row of needles uniformly spaced transversely of the feeding direction;

a second row of needles uniformly spaced transversely of the feeding direction and being longitudinally spaced from said first row of needles;

a needle drive for reciprocating said first and second rows of needles towards and away from a first side of the base fabric to penetrate the base fabric;

wherein the mechanism for moving the base fabric longitudinally through the tufting machine is electronically controllable to feed different lengths of base fabric between selected cyclical penetrations of the base fabric in accordance with the predetermined pattern and wherein the base fabric is supported upon a dulcimer needle plate for penetration by the first and second row of needles.

2. A tufting machine comprising:

a servo motor driven mechanism for moving a base fabric longitudinally through said machine in a feeding direction;

a first row of needles uniformly spaced transversely of the feeding direction;

a second row of needles uniformly spaced transversely of the feeding direction and being longitudinally spaced from said first row of needles;

a needle drive for reciprocating said first and second rows of needles towards and away from a first side of the base fabric to penetrate the base fabric;

wherein the mechanism for moving the base fabric longitudinally through the tufting machine is electronically controllable to feed different lengths of base fabric between selected cyclical penetrations of the base fabric in accordance with the predetermined pattern and wherein the first and second rows of needles are supported upon the same needle bar.

3. The tufting machine of claim 2 wherein the first and second rows of needles are staggered relative to one another.

4. A tufting machine comprising:

a servo motor driven mechanism for moving a base fabric longitudinally through said machine in a feeding direction;

a first row of needles uniformly spaced transversely of the feeding direction;

a second row of needles uniformly spaced transversely of the feeding direction and being longitudinally spaced from said first row of needles;

a needle drive for reciprocating said first and second rows of needles towards and away from a first side of the base fabric to penetrate the base fabric;

wherein the mechanism for moving the base fabric longitudinally through the tufting machine is electronically controllable to feed different lengths of base fabric between selected cyclical penetrations of the base fabric in accordance with the predetermined pattern and wherein the tufting machine is adapted to feed the base fabric a first length on selected stitches and a second length on other stitches, the first length being relatively shorter than the second length.

5. The tufting machine of claim 4 wherein a multiple of the first length is equal to the longitudinal spacing of the second row of needles from the first row of needles.

6. The tufting machine of claim 4 wherein the first length is equal to one-sixth of the longitudinal spacing of the second row of needles from the first row of needles.

7. The tufting machine of claim 4 wherein the second length is equal to one-half of the longitudinal spacing of the second row of needles from the first row of needles.

8. A tufting machine comprising:

a servo motor driven mechanism for moving a base fabric longitudinally through said machine in a feeding direction;

a first row of needles uniformly spaced transversely of the feeding direction;

a second row of needles uniformly spaced transversely of the feeding direction and being longitudinally spaced from said first row of needles;

a needle drive for reciprocating said first and second rows of needles towards and away from a first side of the base fabric to penetrate the base fabric;

wherein the mechanism for moving the base fabric longitudinally through the tufting machine is electronically controllable to feed different lengths of base fabric between selected cyclical penetrations of the base fabric in accordance with the predetermined pattern and further comprising one or more yarn feed devices feeding yarns to the first row of needles, separate from one or more yarn feed devices feeding yarns to the second row of needles.

9. A method of adapting a tufting machine of the type having a servo motor driven mechanism for moving a base fabric longitudinally through said machine in a feeding direction; a first row of needles uniformly spaced transversely of the feeding direction; a second row of needles uniformly spaced transversely of the feeding direction and being longitudinally spaced from said first row of needles; and a needle drive for reciprocating said first and second rows of needles towards and away from a first side of the base fabric to cyclically penetrate the base fabric, to feed different lengths of base fabric between selected cyclical penetrations of the base fabric comprising the steps of:

(a) setting a first length to feed the base fabric;

(b) setting a second length to feed the base fabric;

(c) setting a number of stitches in a base fabric feed pattern repeat; and (d) setting the stitches of the base fabric feed pattern repeat that will feed the base fabric the second length.

10. The method of claim 9 wherein a multiple of the first length is equal to the longitudinal spacing of the second row of needles from the first row of needles.

11. The method of claim 9 wherein the first length is equal to one-sixth of the longitudinal spacing of the second row of needles from the first row of needles.

12. The method of claim 9 wherein the second length is equal to one-half of the longitudinal spacing of the second row of needles from the first row of needles.

13. A method of tufting a fabric with a tufting machine of the type having a servo motor driven mechanism for moving a base fabric longitudinally through said machine in a feeding direction; a first row of needles uniformly spaced transversely of the feeding direction; a second row of needles uniformly spaced transversely of the feeding direction and being longitudinally spaced from said first row of needles; first and second yarns fed to the first and second rows of needles; and a needle drive for reciprocating said first and second rows of needles towards and away from a first side of the base fabric to cyclically penetrate the base fabric comprising the steps of:

(a) operating the needle drive to tuft a first stitch of yarns carried by first needles and a first stitch of yarns carried by second needles;

(b) operating the servo motor driven mechanism to feed a first length of the base fabric through the tufting machine;

(c) operating the needle drive to tuft a second stitch of yarns carried by first needles and a second stitch of yarns carried by second needles; and (d) operating the servo motor driven mechanism to feed a second length of the base fabric through the tufting machine, wherein the second length is relatively longer than the first length.

14. The method of claim 13 wherein the tufting machine further comprises one or more yarn feed devices feeding yarns to the first row of needles, separate from one or more yarn feed devices feeding yarns to the second row of needles, and on a first stitch yarns are fed to at least some of the first needles at a rate different from the rate at which yarns are fed to at least some of the second needles.

15. The method of claim 13 wherein the base fabric is fed through the tufting machine supported upon a dulcimer needle plate.

16. The method of claim 13 wherein the resulting tufted fabric has a relatively uniform stitch density.

17. The method of claim 13 wherein the resulting tufted fabric has the appearance of a woven flat weave fabric.

* * * * *